United States Patent [19]

Uchida et al.

[11] 4,135,709

[45] Jan. 23, 1979

[54] DEVICE FOR PREVENTING THE REVERSE MOVEMENT OF A ROTARY CYLINDER USED IN A PAPER SHEET COUNTER

[75] Inventors: Shinya Uchida; Sinai Moriyama; Minoru Yoshida, all of Tokyo, Japan

[73] Assignee: Laurel Bank Machine Co., Ltd., Tokyo, Japan

[21] Appl. No.: 859,608

[22] Filed: Dec. 12, 1977

[30] Foreign Application Priority Data

Dec. 15, 1976 [JP] Japan ..... 51-150603

[51] Int. Cl.[2] ..... B65H 3/12

[52] U.S. Cl. ..... 271/95; 235/92 SB

[58] Field of Search ..... 271/94, 95, 96, 112; 235/92 SB

[56] References Cited

U.S. PATENT DOCUMENTS

| | | | |
|---|---|---|---|
| 3,652,081 | 3/1972 | Hatanaka | 271/95 |
| 3,953,022 | 4/1976 | Oshima | 271/95 |

*Primary Examiner*—Richard A. Schacher

*Attorney, Agent, or Firm*—Stevens, Davis, Miller & Mosher

[57] ABSTRACT

A stopper means is provided adjacent a rotary cylinder provided on one end surface thereof with suction shafts for deflecting sheets to be counted and rotated for count. The stopper means is provided with an auxiliary stopper for instantaneously engaging with one of the groove formed on the peripheral wall of the rotary cylinder to prevent the reverse movement thereof.

3 Claims, 4 Drawing Figures

Figure 1:
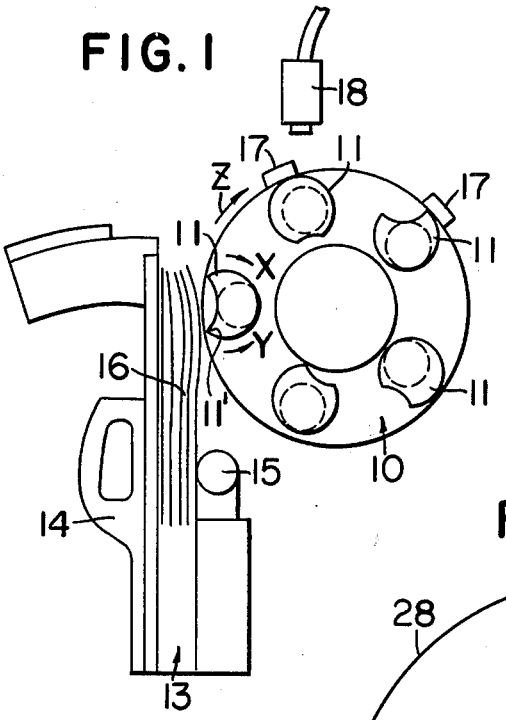

DEVICE FOR PREVENTING THE REVERSE MOVEMENT OF A ROTARY CYLINDER USED IN A PAPER SHEET COUNTER

This invention relates to a device for preventing the reverse movement of a rotary cylinder used in a paper sheet counter.

Generally, in conventional paper sheet counters in which the portions of sheets of paper are sucked one at a time by each of suction shafts mounted on a rotary cylinder at one end surface thereof and are deflected through the rotation of suction shafts and the rotation of the rotary cylinder with count being made through the rotation of the rotary shaft, the rotary cylinder is provided on the peripheral wall thereof with grooves and a stopper mounted on a stopper carriage pivotably mounted adjacent the rotary cylinder engages with one of the grooves to stop the rotary cylinder when the counter is not actuated.

In this kind of the conventional paper sheet counter, at the start of count operation, holding means for clamping a stack of paper sheets is brought up to the position where one of the suction shafts engages with the outermost sheet of the stack and simultaneously a stopper carriage is rotated to disengage a stopper mounted thereon from the groove of the rotary cylinder. As soon as a stopper is disengaged, the rotary cylinder is rotated and count is made by detecting passages of iron pieces by a non-contact switch positioned adjacent the rotary shaft. However, just before the start of count, the rotary cylinder can move freely due to the disengagement of the stopper from the rotary cylinder.

On the other hand, if the stack of paper sheets clamped between the holding plate and the retention member of the hold means should happen to be used bank notes, a free portion of the stack, or the portion of the stack to be sucked may project outwardly as, differently from new notes, used notes have a tendency to bend toward their previous folded state. Under such circumstances, when the rotary cylinder is allowed to move freely, as mentioned above, the projection portion of the stack may push the corner portion of one of the suction shafts engaged therewith in the direction opposite to the forward or normal direction of rotation thus causing the rotary cylinder interlocked with the suction shafts to rotated in the reverse direction. Consequently, one of iron pieces for count mounted on the peripheral wall of the rotary cylinder will move to the position of the non-contact switch of the counter and cause the non-contact switch to give a surplus count.

One object of the invention is, therefore, to provide a device for preventing the reverse movement of the rotary cylinder just after the rotary cylinder is freed by disengagement of the stopper from the rotary cylinder thereby preventing a miscount.

Another object of the invention is to make the above-mentioned device easy to accomplish by merely incorporating an auxiliary stopper means into the conventional stopper means.

A further object of the invention is to make the above-mentioned device easy to assemble at a low cost.

One embodiment according to the invention will now be described with reference to the accompanying drawings.

Figure 2:
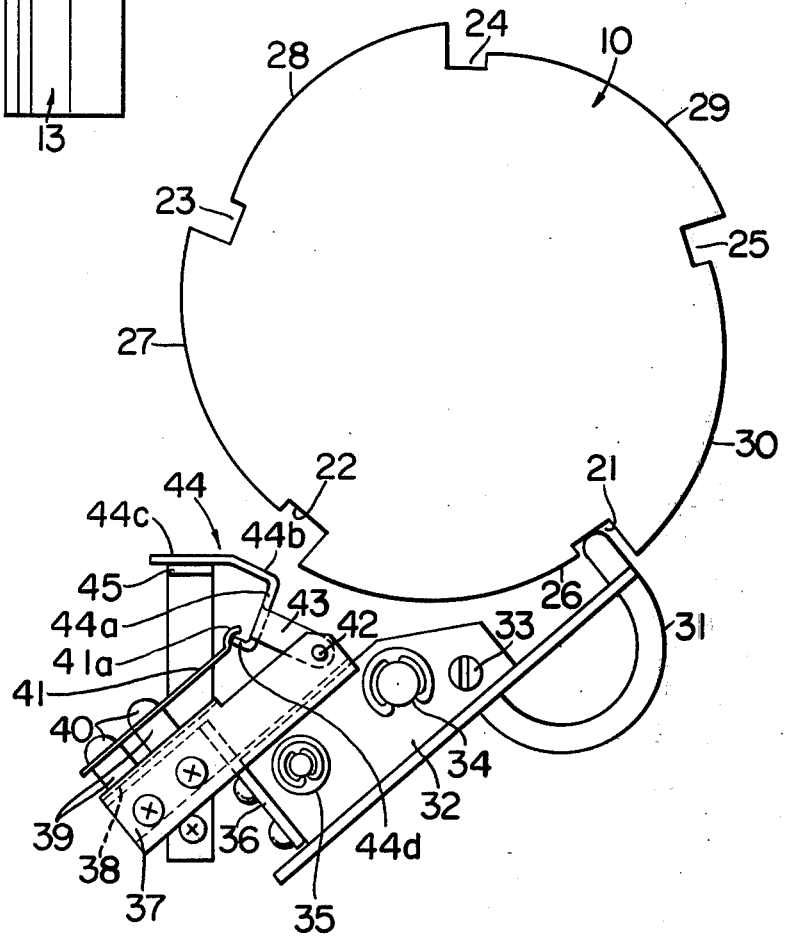
Figure 4:
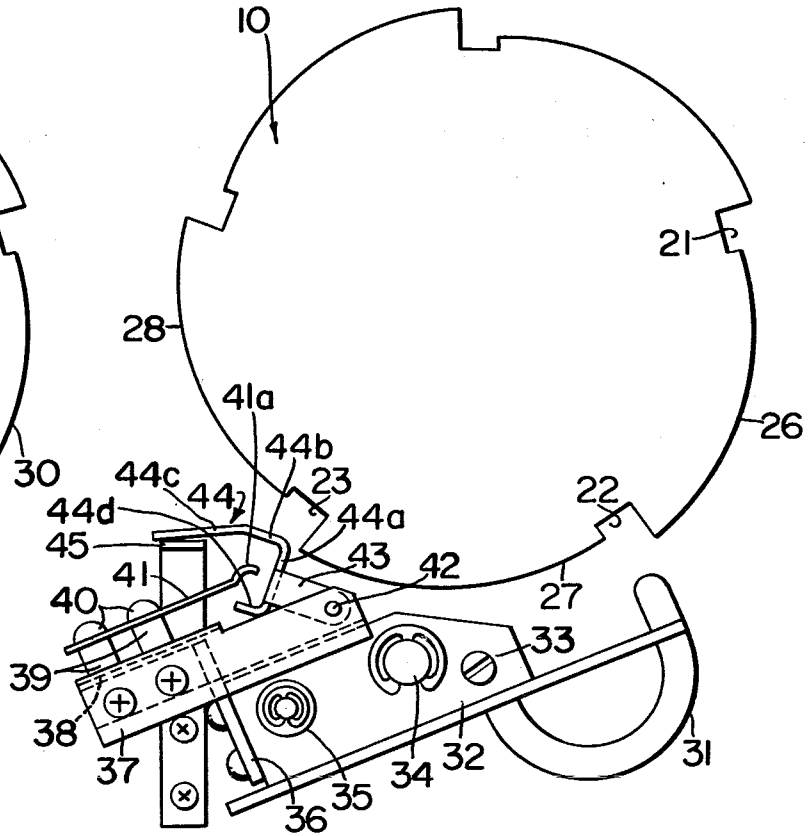
Figure 3:
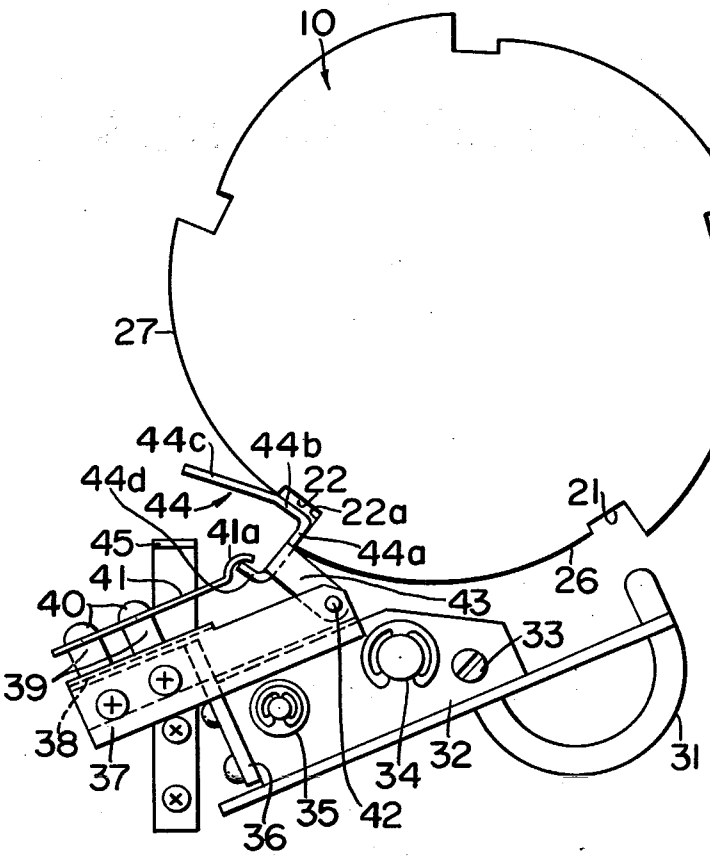

In the drawings:

FIG. 1 is a schematic plan view showing a portion of a paper sheet counter associated with the present invention; and FIGS. 2 to 4 are similar schematic views showing a paper sheet counter incorporating a device according to the invention in sequence of operations.

Referring to the FIG. 1, there is shown a rotary cylinder 10 provided at one end surface thereof with five equally spaced suction shafts 11. The rotary cylinder 10 is rotated in the anticlockwise direction and each of suction shafts 11 interlocked with the rotation of the rotary cylinder is rotated about its own axis in the clockwise direction. The rotary cylinder 10 is provided on the peripheral wall thereof with five iron pieces 17 for count, only two of which are shown in the FIG. 1, corresponding to the five suction shafts, respectively. When one of the iron pieces 17 passes by a non-contact switch 18 of a counter unit positioned adjacent the rotary shaft, "one" is added to the count.

A paper sheet holding means 13 for clamping a stack of paper sheets between a holding plate 14 and a retention member 15 is pivotably mounted about its axis, not shown, on the frame of the counter machine, not shown, adjacent the rotary cylinder 10. The holding means 13 is interlocked with a stopper carriage, hereinafter described, so that the stopper carriage is rotated together with the rotation of the holding means 13.

In operation, a switch, not shown, is turned on and a count signal is produced to cause the paper sheet holding means 13 to be rotated up to the position as shown in the FIG. 1, so that each of the suction shafts 11 can sequentially suck and deflect the portion of the outermost sheet from the paper sheet holding means 13 one at a time as the rotary cylinder 10 rotate. Simultaneously, as shown in FIGS. 2 to 4 a stopper carriage 32 is rotated to disengage a stopper 31 carried by the stopper carriage 32 from the groove 21 which is one of five grooves on the rotary cylinder 10, so that the rotary cylinder can move freely. At this moment, if the stack of paper sheets 16 is used bank notes and the free portion of the stack to be sucked and deflected by the suction shafts projects outwardly, such projected portion of the stack would push the corner portion 11' of the suction shaft 11 in the direction Y opposite to a normal direction X of rotation, which in turn causes the rotary cylinder 10 to be rotated in the reverse direction Z. Consequently, one of the iron pieces 17 mounted on the rotary shaft 10 passes by the non-contact switch 18 and, therefore, gives a surplus count to the switch.

In order to eliminate the above-mentioned disadvantage of the conventional paper sheet counter, the present invention incorporates a device for preventing the reverse movement of the rotary cylinder 10 in the conventional stopping means for the rotary cylinder. The device will now be explained.

Referring now to the FIGS. 2 to 4, there is shown a portion of the rotary cylinder 10 having on its peripheral wall a set of five equally spaced cut-out grooves 21, 22, 23, 24, 25 provided alternately with a set of five equally spaced cam projections 26, 27, 28, 29, 30. This portion of the rotary cylinder shown in the FIGS. 2 to 4 is located below the end surface of the rotary cylinder shown in the FIG. 1 locking in the direction perpendicular to the drawing of the FIG. 1. For clarity of illustration, the suction shafts 11, the holding means 13, the non-contact switch 18, etc are not in the FIGS. 2 to 4. Each cam projection is constructed so that it curves outwardly in the clockwise direction. A U-shaped stopper 31 is positioned opposite to one of the grooves. The stopper 31 is attached by a set screw 33 to the stopper carriage 32 which is pivotably mounted on the frame by a pivot pin 34. The stopper carriage 32 is provided with a pin 35. A spring, not shown, is provided between the pin 35 and the frame to bias the stopper carriage 32 in the anti-clockwise direction about the pivot pin 34. The above-mentioned construction is conventional.

In accordance with the present invention, the stopper carriage is provided at one end thereof with a metal support 36 by which an auxiliary stop plate 37 is attached to the stopper carriage 32 in parallel thereto. A vertical portion 38 integral with or attached to the auxiliary stop plate 37 has a leaf spring 41 attached by screws 40 through spacers 39. The leaf spring 41 is formed with an arc portion 41*a* at the end of the side of the rotary cylinder. A lever 43 is pivotably mounted at one end thereof on the end of the auxiliary stop plate 37 by a pivot pin 42. Attached to the other end of the lever 43 is an auxiliary stopper 44 comprising portions 44*a*, 44*b*, 44*c* and 44*d*. The auxiliary stopper 44 may be integral with the lever 43. The portion 44*d* is fitted at free end thereof in the arc portion 41*a* of the leaf spring and resiliently grasped by the arc portion 41*a* when the rotary cylinder is stopped or not actuated as shown in the FIG. 2. An L-shaped fitting 15 is mounted on the frame on the rear side of the auxiliary stop plate 37 and is positioned opposite to the portion 44*c* of the auxiliary stopper 44. The L-shaped fitting functions to ristrict the movement of the auxiliary stopper 44 by engaging with the portion 44*c* when the portion 44*d* is disengaged from the arc portion 41*a* of the leaf spring 41 as shown in the FIG. 4.

In operation, when a switch of the paper sheet counter, not shown, is turned on, a count signal is produced to cause the holding means 13 for clamping a stack of sheets to rotate in the clockwise direction and simultaneously cause the stopper carriage 32 interlocked with the holding means 13 also to rotate in the clockwise direction against the action of the above-mentioned spring provided between the pin 35 and the frame to disengage the stopper 31 from the groove 31 of the rotary cylinder 10. During the very short period after disengagement, the rotary cylinder 10 can, in the conventional counter, move freely since the rotary cylinder is not forwardly driven at the time. However, in the counter provided with the device of this invention, as soon as the stopper is disengaged, the auxiliary stopper 44 is caused to jump into the groove 22 of the rotary cylinder 10, described later in detail, to confine the free movement of the rotary cylinder 10 and thereby prevent the reverse movement thereof.

Since, as mentioned above, the stopper carriage 32 is rotated in the clockwise direction, the auxiliary stop plate 37 attached to the stopper carriage 32 is also rotated in the clockwise direction. The auxiliary stopper 44 which is now stationary relative to the auxiliary stop plate 37 due to the engagement of the portion 44*d* of auxiliary stopper 44 with the arc portion 41*a* of the leaf spring 41 which is also rotated in the clockwise direction together with the auxiliary stop plate 37.

Consequently, the auxiliary stopper 44 jumps into or is engaged with the groove 22 so that the portion 44*a* of the auxiliary stopper 44 abuts the wall portion 22*a* of the groove 22 as shown in the FIG. 3. Therefore, the rotary cylinder is prevented from moving freely and, thereafter, the reverse movement thereof is prevented.

Subsequently to the engagement of the auxiliary stopper 44 and the groove 22, the rotary cylinder 10 is rotated in the anticlockwise direction by a driving motor, not shown. As the rotary cylinder rotates, the portion 44*b* of the auxiliary stopper 44 slides on the cam projection 27. Since the cam projections are formed to curve outwardly in the direction of rotation, the cam projection 27 pushes the auxiliary stopper 44 outwardly and finally causes the portion 44*d* of the auxiliary stopper 44 to disengage from the arc portion 41*a* of the leaf spring 41 as shown in the FIG. 4. Thereafter, the portion 44*c* of the auxiliary stopper 44 abuts the L-shaped fitting 45 and further movement of the auxiliary stopper 44 is restricted.

Thus, the rotary cylinder continues to rotate for counting the sheets of paper with the auxiliary stopper 44 disengaged from the rotary cylinder.

After the completion of the counting of the sheets of paper, the stopper carriage together with the holding means is returned to its initial position urged by the spring provided between the pin 35 and the frame. When the stopper carriage 32 is rotated in the anticlockwise direction to return to its initial position, the auxiliary stop plate 37 is also rotated in the anticlockwise direction. However, since at the time, the auxiliary stopper 44 remains in its position due to the engagement of the portion 44*c* with the L-shaped fitting 45, the arm portion 41*a* of the leaf spring 41 again engages with the portion 44*d* of the auxiliary stopper as shown in the FIG. 2.

The paper sheet counter is thus ready to perform the next counting operation.

What is claimed is:

1. A paper sheet counter comprising a rotary cylinder provided on one end surface thereof with a plurality of suction shafts for sequentially sucking and deflecting sheets of paper one at a time and having on its peripheral wall a plurality of grooves provided alternately with a plurality of cam projections, and stopper means pivotably mounted to cause a stopper thereof to engage with one of said grooves when the rotary cylinder is not actuated, characterized in that the stopper means is provided with auxiliary stopper means for engaging with another one of said grooves during a very short time after the stopper is disengaged from one of the grooves whereby the auxiliary stopper means prevents the reverse movement of the rotary cylinder.

2. A counter as defined in claim 1, wherein said auxiliary stopper means comprises an auxiliary stop plate attached to the stopper means, a leaf spring attached to the auxiliary stop plate and formed with an arc portion, an auxiliary stopper pivotably mounted on the auxiliary stop plate, one portion of the auxiliary stopper being resiliently engageable with the arc portion of the leaf spring, another portion of the auxiliary stopper being engageable with the said another one of the grooves of the rotary cylinder and means for restricting the movement of the auxiliary stopper.

3. A counter as defined in claim 2, wherein said auxiliary stopper comprises a lever portion pivotably mounted on the auxiliary stop plate, a first portion attached to the lever portion and engageable with the said another one of the grooves, a second portion formed at one end of the first portion and resiliently engageable with the arc portion of the leaf spring, a third portion formed at the other end of the first portion and engageable with one of the cam projections and a fourth portion extending from the third portion and engageable with said restricting means.

* * * * *